United States Patent [19]

Ryan et al.

[11] Patent Number: 5,005,839

[45] Date of Patent: Apr. 9, 1991

[54] BOARD GAME

[75] Inventors: Kyle A. Ryan; Michael Ackerman; Bruce Hale; Ward Payne, all of Seattle, Wash.

[73] Assignee: Turning the Tables, Inc., Seattle, Wash.

[21] Appl. No.: 451,448

[22] Filed: Dec. 15, 1989

[51] Int. Cl.[5] ..... A63F 3/00

[52] U.S. Cl. ..... 273/240; 273/256; 273/273

[58] Field of Search ..... 273/243, 248, 249, 256, 273/273, 240

[56] References Cited

U.S. PATENT DOCUMENTS

| | | | |
|---|---|---|---|
| 3,994,499 | 11/1976 | Barlow | 273/256 |
| 4,118,035 | 10/1978 | Row | 273/243 |
| 4,189,153 | 2/1980 | Zollinger | 273/256 |
| 4,398,721 | 8/1983 | McKay | 273/249 |

*Primary Examiner*—Benjamin Layno

*Attorney, Agent, or Firm*—Christensen, O'Connor, Johnson & Kindness

[57] ABSTRACT

A game apparatus for playing a game in which the players simulate being waitpersons in a restaurant and in which the players take and remember lists of food dishes for later recitation and confirmation as to accuracy includes a board having a playing surface divided into segments, each segment assigned to a different player, each segment having table spaces marked thereon corresponding to tables in a restaurant. A set of table cards corresponding to each of the table spaces is provided and a plurality of order sheets for marking down food dishes being ordered is also provided. The order sheets are of a size smaller than the table cards so that they can be covered from view by the table cards during play of the game. A plurality of markers is provided, one marker associated with each player. The markers are moved around the playing surface to predetermined spaces marked on the playing surface. When the predetermined spaces are reached the player can begin taking and reciting orders in order to gain points sufficient to win the game. Preferably, two sets of action cards are provided, bearing messages that affect either the number of points of a player or the position of the player's marker on the playing surface. Preferably, points are kept in terms of dollars and token money, in the form of various denominations, is provided to the players to use in keeping track of the score.

5 Claims, 4 Drawing Sheets

BOARD GAME

BACKGROUND OF THE INVENTION

This invention relates to an apparatus for playing a board game and, in particular, relates to an apparatus for playing a board game in which the players act as waitpersons taking orders for various food items, remembering them, and then later reciting the orders.

Games employing movement of playing pieces over a game board are popular and game boards with rectangular, circular, and abstract patterns have been developed for playing such games. However, game apparatus have not been provided that simulate a restaurant situation in which the players assume the roles of waitpersons and, in accordance with the movement of a marker piece on the board, achieve positions in which they are required to take orders for food items from other players and then, after another series of movements of the marker piece on the board, recite those orders from memory, being rewarded for a successful recitation.

SUMMARY OF THE INVENTION

A game apparatus is provided for playing a board game in which the players simulate being waitpersons in a restaurant. The game includes the taking and remembering of lists of food dishes from menus provided as part of the game. The ordered foods are then recited at a later time and confirmed as to accuracy with some reward in the form of points or token dollars being awarded for accurate recitation.

The game apparatus includes a board having a playing surface that is divided into sections, each of the sections being assigned to a different player. Each of the sections has a number of table spaces marked thereon, which correspond to tables in a restaurant. A set of table cards corresponding to each of the table spaces is provided to each player and a plurality of order sheets for marking down food dishes being ordered are also provided. The order sheets are preferably of a size smaller than the table cards so that they can be covered by the table cards. A plurality of markers, one marker associated with each player, are also provided, with the markers being moved around the board and orders being taken and recited by a given player only when that player's marker is on a predetermined space associated with the player's designated section of the playing surface. The preferred embodiment of the game also includes action cards that contain messages thereon relating to an advantage or disadvantage given to the player who chooses the action card. Preferably, the action cards are kept on the board in spaces designated for that purpose.

BRIEF DESCRIPTION OF THE DRAWINGS

The above-referenced invention will be better understood by those of ordinary skill in the art and others after reading the ensuing specification taken in conjunction with the appended drawings wherein.

DETAILED DESCRIPTION OF THE PREFERRED EMBODIMENT

Game Apparatus

Figure 1:
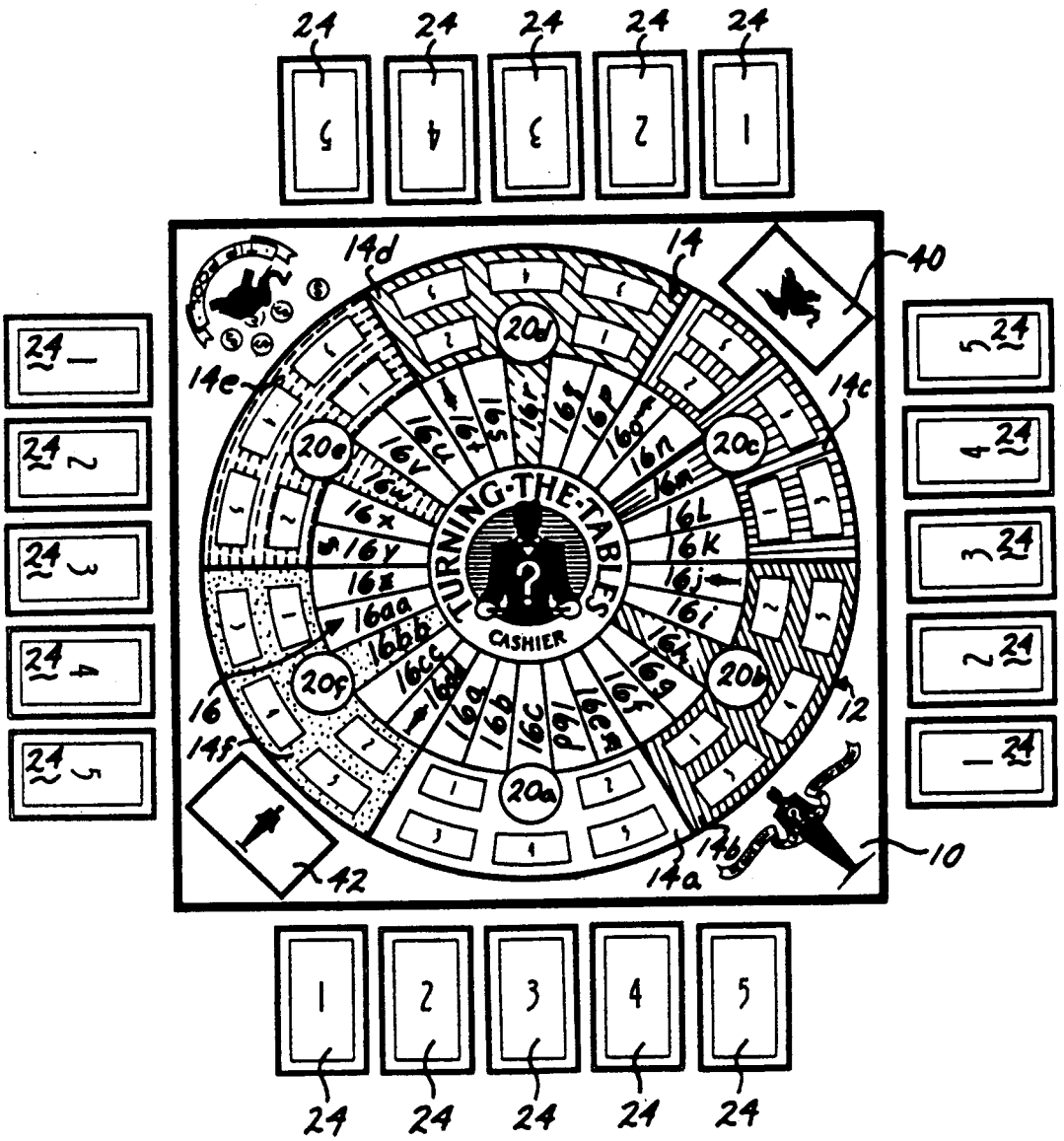
FIG. 1 is a plan view of one embodiment of a board made in accordance with the principles of the present invention.

FIG. 1 illustrates one embodiment of a game board made in accordance with the principles of the present invention. The game board 10 includes a circular playing area 12 illustrated on the board. The circular playing area 12 includes an outer annular section 14 and an inner annular section 16 that is concentric with the outer annular section 14. At the center of the circular playing surface is a circular section 18, known in the game as the "cashier's circle". The outer annular section 14 is divided into segments **14*a* through 14*f*, each of the segments being designated with a unique indicia, for example, a different color. The inner annular section 16 is divided into radially directed wedge sections 16*a* through 16*dd*. The wedge sections are of equal size and distributed so that an equal number of wedge sections is bordered by each segment 14*a* through 14*f* of the outer annular section. The center wedge of each group of five wedge sections, for example, section 16*c*, of the group made up of sections 16*a* through 16*e*, is marked with an indicia associated with the indicia marked on its respective segment 14*a* through 14*f*. At a first end of each of these central wedge sections where the wedge section is contiguous with its associated segment of the outer annular section, are circular spaces 20*a* through 20*f*, respectively. The circular space in the terminology of the game is known as the "busing station" and its function will be described later. Each of the segments 14*a* through 14*f*** has set off within it five quadrilateral spaces that are marked one through five and are designated the "table spaces" and are intended to be representative of tables in a restaurant.

Figure 6:
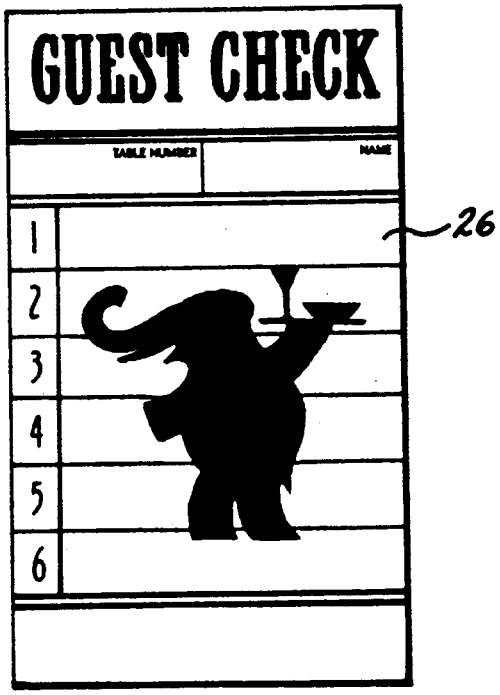
FIG. 6 is an illustration of the order blanks or guest checks provided to each player for recording information during the game.
Figure 7:
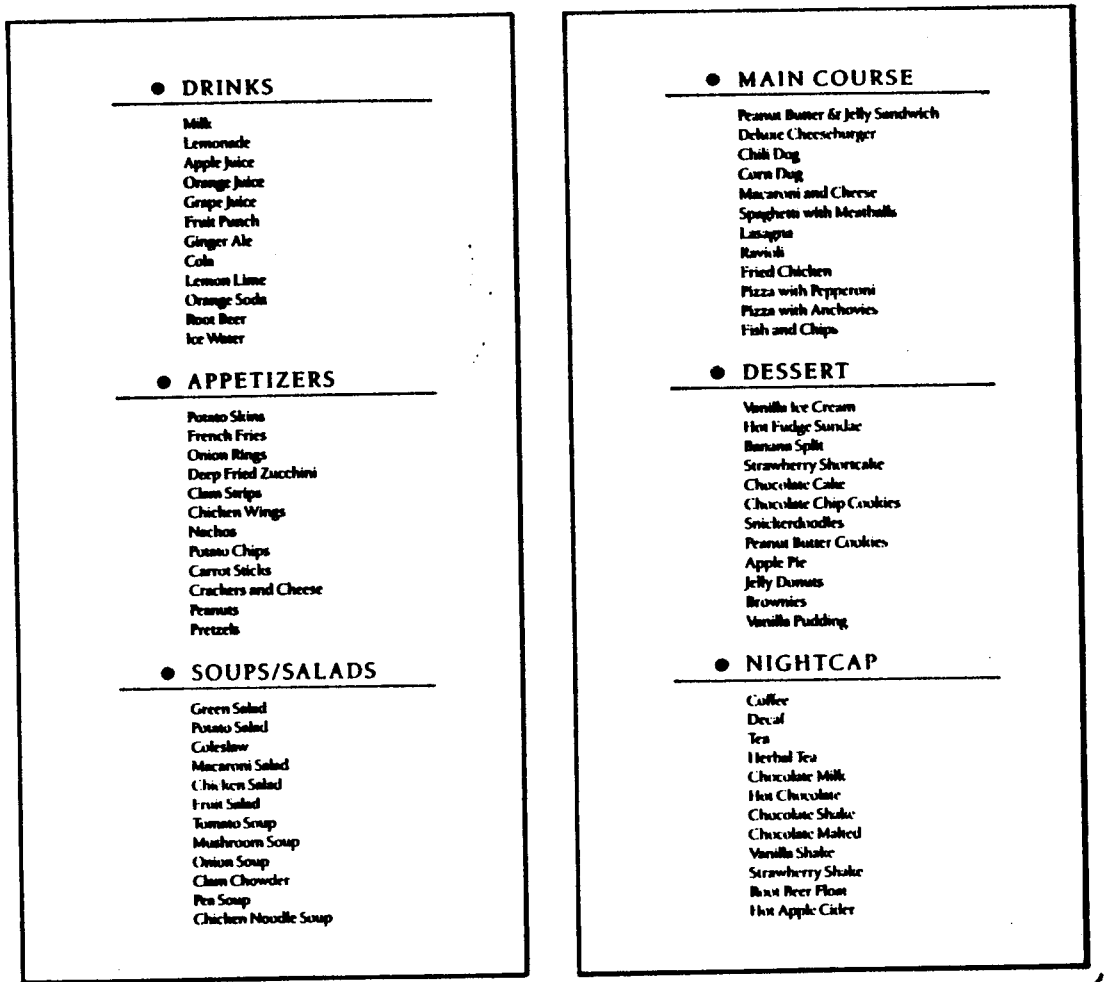
FIG. 7 is an illustration of the menu lists provided with the game apparatus.

The game equipment includes sets of table cards 24. The cards are grouped in groups corresponding to the number of table spaces in each segment **14*a* through 14*f*. In the illustrated embodiment there are five cards in each set corresponding to the five table spaces marked in each segment 14*a* through 14*f* of the playing surface. In FIG. 1 a typical four-player configuration is shown where the table cards of each of the players are arranged around the perimeter of the game board 10. The table cards 24 are used to cover the guest check sheets 26, which are shown in FIG. 6**. The purpose of the guest checks will be described later.

Figure 2:
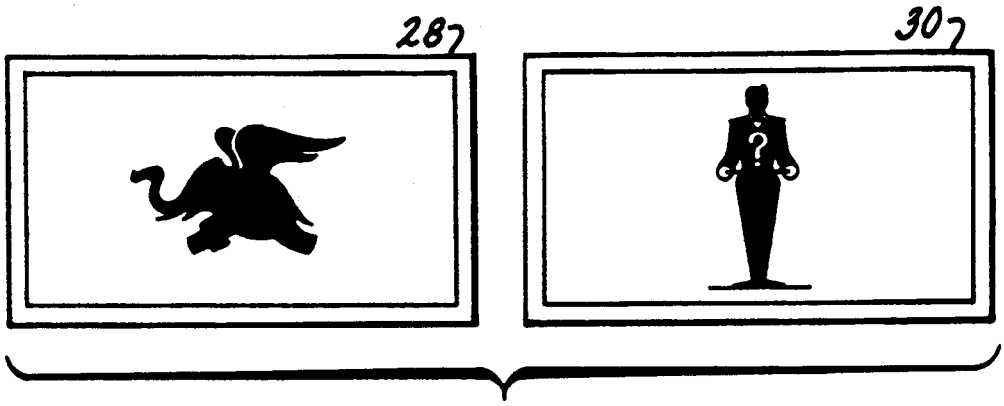
FIG. 2 is a plan view of the back or nonmessage side of action cards made in accordance with the principles of the present invention.
Figure 3:
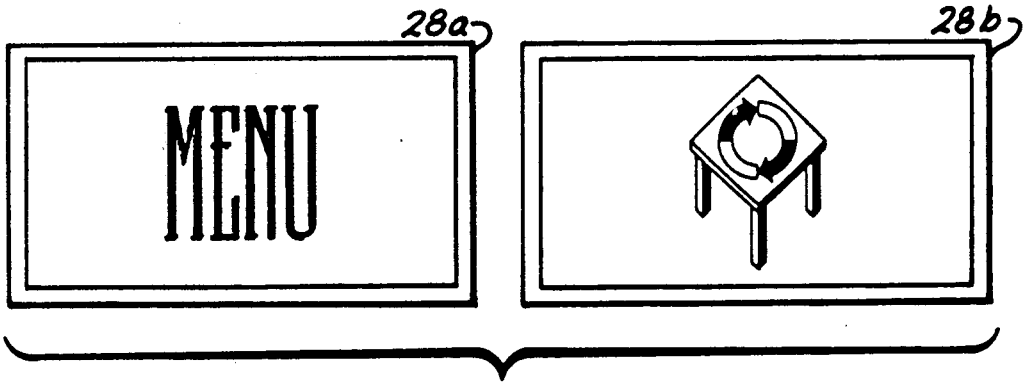
FIG. 3 is a plan view of the front or message side of two of the action cards.

FIGS. 2 and 3 illustrate action cards 28 and 30; the back or nonmessage sides of the cards are shown in FIG. 2. The cards 28 have a flying elephant design on them and the cards 30 have a waiter design marked thereon, although the designs are arbitrary and are not critical to the invention. On the reverse side of the cards 28 and 30 are legends that either advantage or disadvantage the player who draws the card. For example, the cards 28 can affect the position of the player on the board and the cards 30 can require the player to either pay or receive extra money as represented by the five-, ten-, and twenty-dollar bills 34, 36, and 38, respectively, shown in FIG. 3. On at least some of the action cards the word "menu" appears as shown in the action card 28*a* in FIG. 3. On some of the other action cards a table symbol appears as shown in FIG. 3 in action card 28*b*; again, the purpose and function of these cards will be described later in conjunction with the description of play of the game. Certain of the spaces 16*a* through 16*dd* are marked with an indicia that determines that one of the action cards 28 or 30 is to be chosen. For example, space 16*e* has an elephant on it that indicates an elephant card 28 is to be taken.

In addition to the items described to this point, the game apparatus also includes menus (not shown) that contain lists of food items that are used during the game in the taking and recording of orders as part of the game play.

Play of the Game

Figure 4:
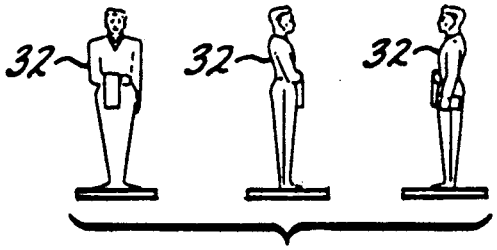
FIG. 4 is a set of orthographic projections of a marker piece made in accordance with the principles of the present invention.
Figure 5:
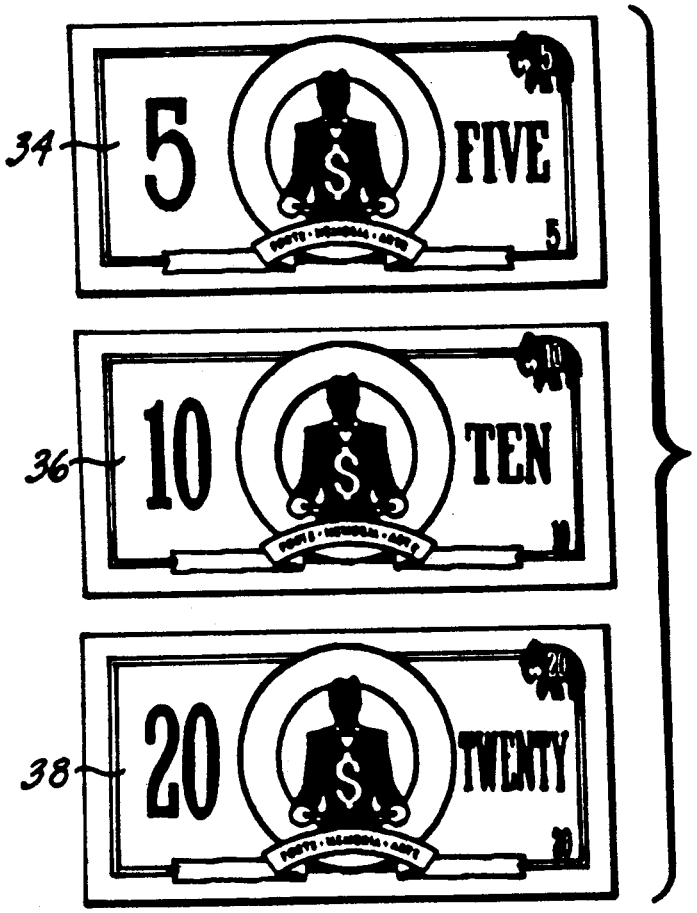
FIG. 5 is an illustration of the typical game money provided with the game apparatus.

The game apparatus described above can be used to play the game described as follows. At the beginning of each game each of the players is assigned to a particular segment 14*a* through 14*f* of the board 10 and assumes the role of a waiter with respect to the five table spaces 24 in that segment. The players are each provided with a marker that signifies their position on the board. A possible marker is shown in FIG. 4 as marker 32. Marker 32 is in the shape of a waiter; however, this is not critical to the game and any shape marker will do. It is preferable that the markers 32 be capable of differentiation so that each player can identify his or her marker. One simple way to accomplish this is to color the markers with a color matching the color of the segment to which the player is assigned. Alternatively, differently shaped markers could be used so that each player could distinguish his marker from those of the other players.

Each player receives five matching table cards 24, which are placed in front of the player next to the edge of the board 10 in a manner similar to that shown in FIG. 1. The player also receives a pad of guest checks 26, a pencil, and an amount of token money, for example, $50 in the form of one 20-dollar bill 38, a ten-dollar bill 36, and four five-dollar bills 34. The two decks of action cards, namely, the elephant deck 28 and the waiter deck 30, are shuffled and placed into appropriate squares 40 and 42 marked on the corners of the game board 10. A predetermined amount of money, for example, $50 in five-dollar bills 34, is placed under a corner of the board 10, which is marked "tip pool" in FIG. 1. The players all place their markers 32 into the cashier's circle 18. A menu is chosen either by lot or by some other means and that menu is used until it is changed according to the rules that follow.

Each player in turn rolls a pair of dice and moves his marker according to the number indicated on the dice. The movement begins at the cashier's circle 18 and moves out onto the colored lane 16*c*, 16*h*, 16*m*, 16*r*, 16*w*, or 16*bb* associated with the segment 14*a* through 14*f* assigned to that player. The player then moves the marker 32 along the wedge sections 16*a* through 16*dd* in a clockwise direction. Once the first player has moved the number of spaces indicated on the dice, the next player rolls the dice and moves his marker the same way except that he begins at the lane associated with his segment 14*a* through 14*f*. The players then take turns moving their markers around the board until one of the players returns back to the lane associated with his assigned segment. Once the player has returned to his assigned lane, the player can move into the busing station 20*a* through 20*f* associated with that lane and begin taking orders. When the player is in the busing station, the player to his immediate left assumes the role of a customer and throws one of the dice to see how many courses will be ordered. The customer then chooses a number of items from the menu corresponding to the number that is rolled on the die. The player in the role of waiter writes down the order on the guest check and then places the guest check beneath one of the table cards in order from one to five. The waiter can choose how many tables he will take orders for, from one to five, and the number of tables is at the player's discretion depending on his confidence in his memory ability. Once the order-taking process is completed, play continues with the other players rolling the dice and moving around the board in turn, trying to reach their respective busing stations 20*a* through 20*f*. Once a player has made it around the board and reaches his associated lane a second time, that player can again enter the busing station and begin "delivering" orders. At that time, the waiter, beginning with table one, recites back from memory the food items ordered on the previous round. The customer, using the guest check 26 that has been taken from beneath the table card, checks on the accuracy of the waiter's recitation. As the order is repeated, the customer keeps track of the right and wrong items listed and the player is either tipped $5 for each item correctly remembered or must pay the bank $10 if no items at all for a particular table are remembered. It is necessary to deliver the orders that were taken from all of the tables in a player's segment prior to beginning to take orders again at table one. Also, a player must wait until the next turn to take more orders after the previously taken orders have been delivered.

The game progresses and money is added or subtracted to each player's total based on the success they have in accurately remembering the orders. Many ways are potentially available to determine when the game should end; for example, when a certain dollar amount, say $250, is reached by any one player, that player may have the option of terminating the game and the players can simply add up their money and decide the winner by the player who has the most money.

In order to add to the suspense and interest of the game, action cards 28 and 30 are provided. One of the decks of action cards, for sake of example, the elephant cards 28, includes the menu cards 28*a* and cards with the table symbol on them 28*b* as well as other cards that affect the players' progress around the board, for example, "take an extra turn," "lose a turn," "advance a space," "advance a section," et cetera. If the menu card 28*a* is chosen by a player, that player has an option of changing the menu that is in use for the remainder of the game. The card 28*b* with the table symbol is kept by the player who chooses it until it is used to "turn the tables" on an opponent by forcing them to pay money in a situation where the player would otherwise have had to pay.

The second set of cards, in this case, the waiter cards 30, contain messages dealing with the payment of money, either to other players or the bank, or the receipt of money by that player from either the other players or the bank. Therefore, combining the sets of cards, if a player who has previously chosen a "turn the tables" card 28*b* later receives a card that requires him to pay $10 to the bank, he can use the "turn the tables"

card 28*b* to force the bank to pay him the $10 instead. Once the "turn the tables" card has been used it must be returned to the bottom of the pile.

The game described is intended to simulate the taking of orders in a restaurant by a waiter. The board is divided into segments representative of different areas of a restaurant or even different restaurants and each player is assigned to a particular segment. Each segment of the board is further divided into spaces indicative of tables in the restaurant and each table is entitled to order a series of items from a given menu in correspondence to the number rolled on a die. The board is divided further into spaces over which a marker is moved representative of the player; the player must navigate the board in a specific manner prior to being able to take and deliver orders in order to receive points or money. The orders are written down on guest checks that are then placed under table cards corresponding to the table spaces marked on the board. The guest checks are used to confirm the recitation by the player of the items ordered and are not intended to be read by the player when such recitation is made. In order to enhance the game action, sets of cards having messages thereon that are either an advantage or disadvantage to the player are chosen by the player when landing on a predetermined space marked with a unique designation. The action cards can either provide the player with additional money, cause the player to pay out money to the bank or other players, or affect the position of the player on the game board. Preferably, each of the board segments is coded by some indicia and the markers are provided with a matching indicia to enable the player to track his progress on the board.

While a particular board design has been described and illustrated, it should be understood that other designs are possible while remaining within the scope of the invention. For example, the playing surface can be divided into more or fewer segments; the number of tables could be increased or decreased from the five illustrated; and various types of indicia could be used to separate the segments on the board, whether it be color or a particular design pattern. Also, while dice are used to determine the movement of the marker on the board and to determine other features of the game, it would be possible to use other indicators, such as a pointer or spinner, as well as dice. Since changes can be made to the illustrated and described embodiment while remaining within the scope of the invention, the invention should be defined solely with reference to the appended claims.

The embodiments of the invention in which an exclusive property or privilege is claimed are defined as follows:

1. A method of playing a game in which the players simulate being waitpersons in a restaurant, the game including the taking and remembering of lists of food dishes for later recitation and confirmation as to accuracy, comprising the steps of:

providing a board having a playing surface divided into sections, each section having table spaces marked thereon corresponding to tables in a restaurant;

providing a set of table cards corresponding to each of the table spaces;

providing a plurality of order sheets, said order sheets sized such that they are capable of being covered by said table cards; and providing a plurality of markers, one marker associated with each player, providing a menu containing food items, assigning each section and its corresponding table spaces to a different player, placing said markers on each of said assigned section, moving said markers on said playing surface a first players marker and when is moved to a predetermined space within a section associated with that player permitting an opposing player to order a plurality of food items from said menu, said first player taking the food order by marking ordered food items on an order sheet, and covering said order sheet with a table card, and said first player reciting said food order back.

2. The method of claim 1, further including providing bill of money used to reward players for accurately reciting food dishes that have been written on said order sheets.

3. The method of claim 2, wherein said playing surface is further divided into spaces forming a closed path, said players moving their associated markers along said path to encounter said predetermined spaces for permitting the taking of food orders.

4. The method of claim 3, further including providing a first set of action cards bearing messages on them that affect the position of the player on the board, wherein certain of said spaces on said board are marked such that a marker landing on said space indicates that the player is to choose an action card.

5. The method of claim 4, further including providing a second set of action cards bearing messages that affect the points of the player, causing the player to either retain, give away, or add points, depending on the message on the card and wherein certain of said spaces are marked with a second indicia such that when a marker lands on such a space the player is required to choose one of said second action cards.

* * * * *

UNITED STATES PATENT AND TRADEMARK OFFICE

CERTIFICATE OF CORRECTION

PATENT NO. : 5,005,839

DATED : April 9, 1991

INVENTOR(S) : Ryan et al.

It is certified that error appears in the above-identified patent and that said Letters Patent is hereby corrected as shown below:

| COLUMN | LINE | |
|---|---|---|
| 6 | 22 | "section" should read --sections-- |
| 6 | 23 | insert --and when-- before "a first" |
| 6 | 24 | "players" should read --player's-- |
| 6 | 24 | delete "and when" |
| 6 | 33 | "bill" should read --bills-- |

Signed and Sealed this

Twenty-first Day of September, 1993

Bruce Lehman

*Attest:*

BRUCE LEHMAN

*Attesting Officer*

*Commissioner of Patents and Trademarks*